US007188487B2

(12) United States Patent
Choi

(10) Patent No.: US 7,188,487 B2
(45) Date of Patent: Mar. 13, 2007

(54) DISPENSER FOR REFRIGERATOR

(75) Inventor: Chang-bong Choi, Changwon (KR)

(73) Assignee: LG Electronics Inc., Seoul (KR)

( * ) Notice: Subject to any disclaimer, the term of this patent is extended or adjusted under 35 U.S.C. 154(b) by 413 days.

(21) Appl. No.: 10/811,945

(22) Filed: Mar. 30, 2004

(65) Prior Publication Data

US 2004/0188466 A1 Sep. 30, 2004

(30) Foreign Application Priority Data

Mar. 31, 2003 (KR) ..... 10-2003-0020073

(51) Int. Cl.
*B67D 5/62* (2006.01)

(52) U.S. Cl. ..... 62/389

(58) Field of Classification Search ..... 62/389, 62/444, 447; 220/146.6; 222/146.6, 189.09, 222/190

See application file for complete search history.

(56) References Cited

U.S. PATENT DOCUMENTS 4,696,417 A * 9/1987 Ugolini ..... 222/146.6
4,800,935 A * 1/1989 Buchser et al. ..... 141/362
4,912,942 A * 4/1990 Katterhenry et al. ..... 62/338
5,791,523 A * 8/1998 Oh ..... 222/146.6
6,003,734 A * 12/1999 Oh ..... 222/146.6

* cited by examiner

*Primary Examiner*—Melvin Jones
(74) *Attorney, Agent, or Firm*—Birch, Stewart, Kolasch & Birch, LLP

(57) ABSTRACT

The present invention relates to a dispenser for a refrigerator. The dispenser includes a housing that is mounted on a front surface of a door to define an external appearance and has a recessed portion formed to be depressed rearward; a dispensing port for discharging water delivered from a main body of the refrigerator to the recessed portion of the housing, a water-dispensing button unit having a water-dispensing button pressed by force exerted by a user to receive a signal necessary for the discharge of the water from the dispensing port; an actuating switch operated by the water-dispensing button unit to generate a signal for opening and closing the dispensing port; and a driving lever for connecting the actuating switch and the water-dispensing button to drive the actuating switch by the operation of the water-dispensing button According to the present invention, the water discharged from the dispensing port is effectively avoided from being transferred to the actuating switch, thereby preventing the occurrence of a short circuit in the actuating switch.

15 Claims, 6 Drawing Sheets

DISPENSER FOR REFRIGERATOR

This Non-provisional application claims priority under 35 U.S.C. §119(a) on Patent Application No(s). 10-2003-0020073 filed in Korea on Mar. 31, 2003, the entire contents of which are hereby incorporated by reference.

BACKGROUND OF THE INVENTION

1. Field of Invention

The present invention relates to a refrigerator, and more particularly, to a dispenser for a refrigerator, which can allow water to be dispensed outside without opening a door of the refrigerator.

2. Description of the Prior Art

Refrigerators recently sold on the market have dispensers that allow water to be dispensed from the interiors of the refrigerators to the outside without opening doors of the refrigerators. Since the dispensers can allow water to be dispensed without opening the doors of the refrigerators, they can prevent cold air within the refrigerators from leaking out and also provide users with convenience of use of the refrigerators. The dispensers are typically installed at the doors of the refrigerators. Generally, a portion of an outer surface of a door of each refrigerator is recessed inward, and a dispenser is then installed within the recessed portion.

FIG. 1 shows a front face of a refrigerator with a dispenser. In the refrigerator, a storage space is formed within a main body 10 of the refrigerator. The storage space roughly comprises a refrigerating chamber and a freezing chamber. The refrigerating and freezing chambers are opened and closed by a refrigerating chamber door 12 and a freezing chamber door 14, respectively. Reference numerals 16 and 16' designate handles for the doors of the refrigerator.

A dispenser 18 is provided on a front surface of the door 12. The dispenser 18 is supplied with water from the main body 10 through a water supply tube 20 installed within the door 12. The water supply tube 20 is installed through a hinge portion on which the door 12 pivots to be opened and closed.

The dispenser 18 is provided with a water-dispensing button 24 operated by a user, and a dispensing port 26 at a position adjacent to the water-dispensing button 24. Water delivered from a water reservoir (not shown) installed within the main body 10 through the water supply tube 20 is discharged from the dispensing port 26. That is, when the user pushes the water-dispensing button 24 upward, the water delivered from the water reservoir (not shown) installed within the main body 10 is discharged from the dispensing port 26.

The dispensing port 26 is typically provided on a ceiling of a recessed portion in the door 12 where the dispenser 18 is installed. The water-dispensing button 24 is formed to protrude behind and downward beyond the dispensing port 26. Reference numeral 28 designates a water-collecting portion for collecting remaining water.

Meanwhile, FIG. 2 shows the configuration of a major portion of the dispenser 18. That is, the water-dispensing button 24 is mounted slidably upward and downward in the dispenser 18, an actuating switch 30 is placed at a relatively upper position over the water-dispensing button 24, and the dispensing port 26 is installed at an upper position above and in front of the water-dispensing button 24 and at a leading end of the water supply tube 20 so as to discharge water downward.

Therefore, when the water-dispensing button 24 is pushed upward, a resilient rib 32 of the actuating switch 30 interlocked with the water-dispensing button 24 is also pushed upward so that the actuating switch 30 can be turned on. The dispensing port 26 is opened upon reception of a signal from the actuating switch 30 and allows water to be dispensed outside.

However, such a conventional refrigerator described above has the following problems.

Since the water-dispensing button 24 is generally operated by a cup, the dispensing port 26 is inevitably installed in the vicinity of the water-dispensing button 24 to securely deliver water to the cup. Further, the resilient rib 32 of the actuating switch 30 is connected directly to the water-dispensing button 24 in the prior art. Thus, the actuating switch 30, the water-dispensing button 24 and the dispensing port 26 are inevitably installed to be closer to one another.

In view of such a constitution, water may be easily transferred to the actuating switch 30 if the direction of the water discharged from the dispensing port 26 deviates slightly or water leaks out at a connection of the dispensing port 26 to the water supply tube 20. Moreover, since the resilient rib 32 is connected directly to the water supply button 24, water splashed on the water-dispensing button 24 may be transferred to the actuating switch 30 via the resilient rib 32.

Consequently, since water may be easily transferred to the actuating switch 30 in the prior art, a short circuit may occur in the actuating switch, resulting in damage to the actuating switch 30 in critical circumstances.

SUMMARY OF THE INVENTION

Accordingly, the present invention is conceived to solve the problems in the prior art. An object of the present invention is to protect an actuating switch for providing signals for opening and closing a dispensing port of a dispenser for a refrigerator against water.

According to an aspect of the present invention for achieving the object, there is provided a dispenser for a refrigerator, comprising a housing that is mounted on a front surface of a door to define an external appearance and has a recessed portion formed to be depressed rearward; a dispensing port for discharging water delivered from a main body of the refrigerator to the recessed portion of the housing; a water-dispensing button unit having a water-dispensing button pressed by means of force exerted by a user to receive a signal necessary for the discharge of the water from the dispensing port; an actuating switch operated by the water-dispensing button unit to generate a signal for opening and closing the dispensing port; and a driving lever for connecting the actuating switch and the water-dispensing button to drive the actuating switch by means of the operation of the water-dispensing button.

A penetration portion may be formed at an upper end of the recessed portion of the housing so that the water discharged from the dispensing port can be delivered to the recessed portion.

The water-dispensing button unit may comprise a support frame for guiding the movement of the water-dispensing button; and a resilient member disposed between the support frame and the water-dispensing button to provide force to the water-dispensing button in one direction.

The water-dispensing button unit may be provided, at mutually corresponding positions of the water-dispensing button and the support frame, with catching ribs and guide ribs for guiding the movement of the water-dispensing button and regulating the moved position of the water-dispensing button, respectively.

An ON/OFF driving protrusion of the actuating switch may be operated by an elastically deformable resilient rib provided at a side of the actuating switch, and the resilient rib may be operated by one end of the driving lever.

The driving lever may pivots on a hinge portion such that both ends thereof move in the same manner as a seesaw, and one end of the driving lever may be connected to and interlocked with the water-dispensing button through a connection protrusion and the other end thereof may be in contact and interlocked with the actuating switch.

The other end of the driving lever that is in contact with the actuating switch may be placed at a position relatively higher than the end of the driving lever that is connected to the water-dispensing button with respect to the hinge portion.

The both ends of the driving lever may define a predetermined angle around the hinge portion, and the other end of the driving lever that is in contact with the actuating switch may be placed at a position relatively higher than the end of the driving lever that is connected to the water-dispensing button.

The dispenser may further comprise a partition between the actuating switch and the dispensing port.

The dispensing port, the actuating switch and the driving lever may be placed in a seating recess formed to be depressed on the front surface of the door, and the water-dispensing button unit may be provided at an upper end of the recessed portion of the housing.

According to another aspect of the present invention, there is provided a dispenser for a refrigerator, comprising a housing that is mounted on a front surface of a door to define an external appearance and has a recessed portion formed to be depressed rearward; a dispensing port for discharging water delivered from a main body of the refrigerator through a penetration portion formed at an upper end of the recessed portion of the housing; a water-dispensing button unit having a water-dispensing button pressed by means of force exerted by a user to receive a signal necessary for the discharge of the water from the dispensing port; an actuating switch operated by the water-dispensing button unit and turned on and off in such a manner that a resilient rib provided at a side of the actuating switch presses a driving protrusion thereof by means of elastic deformation of the resilient rib so as to generate a signal for opening and closing the dispensing port; a driving lever for connecting the actuating switch and the water-dispensing button to drive the actuating switch by means of the operation of the water-dispensing button; and a partition disposed between the actuating switch and the dispensing port to prevent the water discharged from the dispensing port from being transferred to the actuating switch.

The water-dispensing button unit may comprise a support frame for guiding the movement of the water-dispensing button; and a resilient member disposed between the support frame and the water-dispensing button to provide force to the water-dispensing button in one direction.

The driving lever may pivot on a hinge portion such that both ends thereof move in the same manner as a seesaw, and one end of the driving lever may be connected to and interlocked with the water-dispensing button through a connection protrusion and the other end thereof may be in contact and interlocked with the actuating switch.

The other end of the driving lever that is in contact with the actuating switch may be placed at a position relatively higher than the end of the driving lever that is connected to the water-dispensing button with respect to the hinge portion.

The both ends of the driving lever may define a predetermined angle around the hinge portion, and the other end of the driving lever that is in contact with the actuating switch may be placed at a position relatively higher than the end of the driving lever that is connected to the water-dispensing button.

According to the present invention, there is an advantage in that it is possible to prevent a short circuit occurring in the actuating switch due to water dispensed by the dispenser.

BRIEF DESCRIPTION OF THE DRAWINGS

The above and other objects and features of the present invention will become apparent from the following description of a preferred embodiment given in conjunction with the accompanying drawings, in which.

DETAILED DESCRIPTION OF THE PREFERRED EMBODIMENTS

Hereinafter, a preferred embodiment of a dispenser for a refrigerator according to the present invention will be described in detail with reference to the accompanying drawings.

Figure 1:
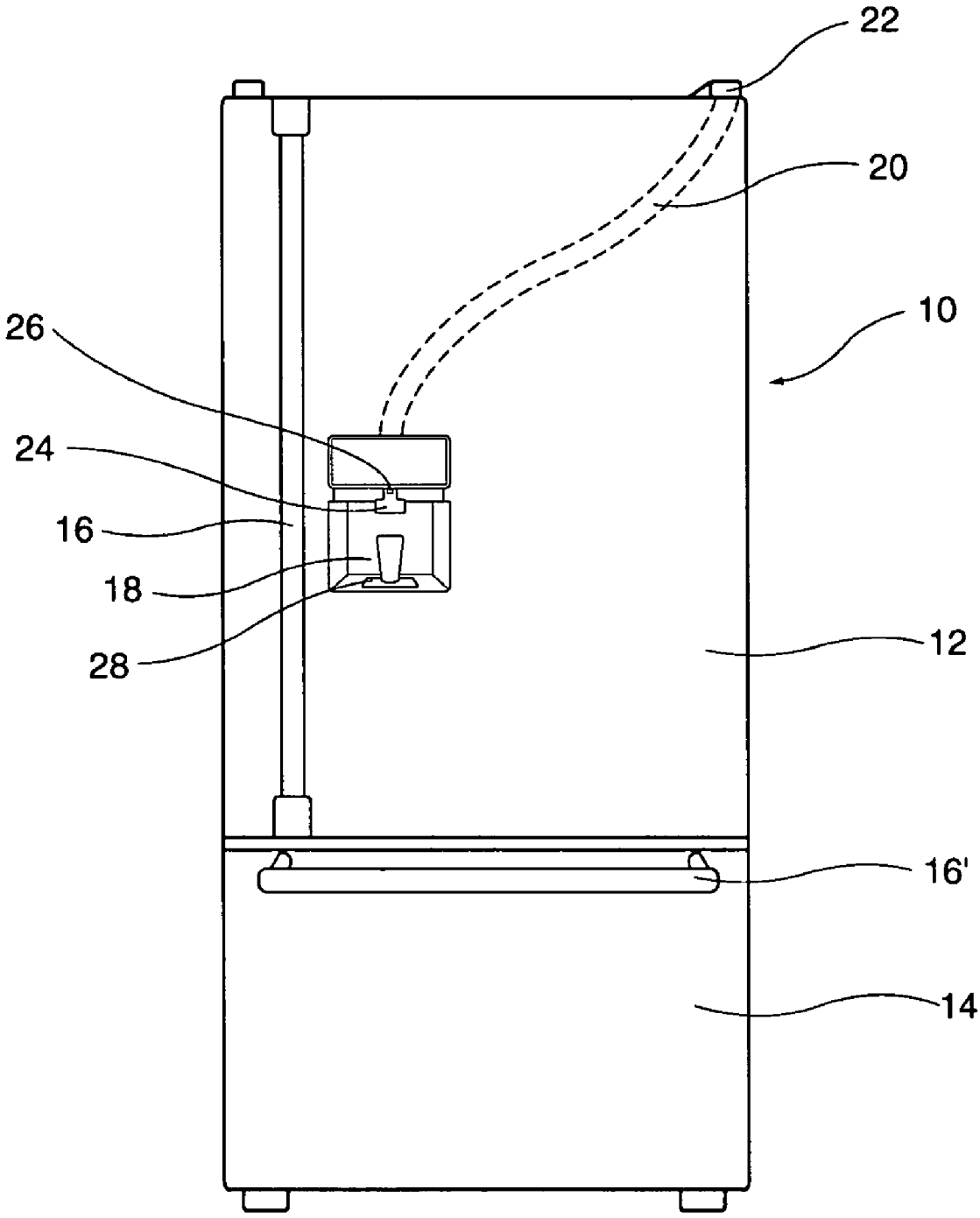
FIG. 1 is a front view showing a front face of a conventional refrigerator.
Figure 2:
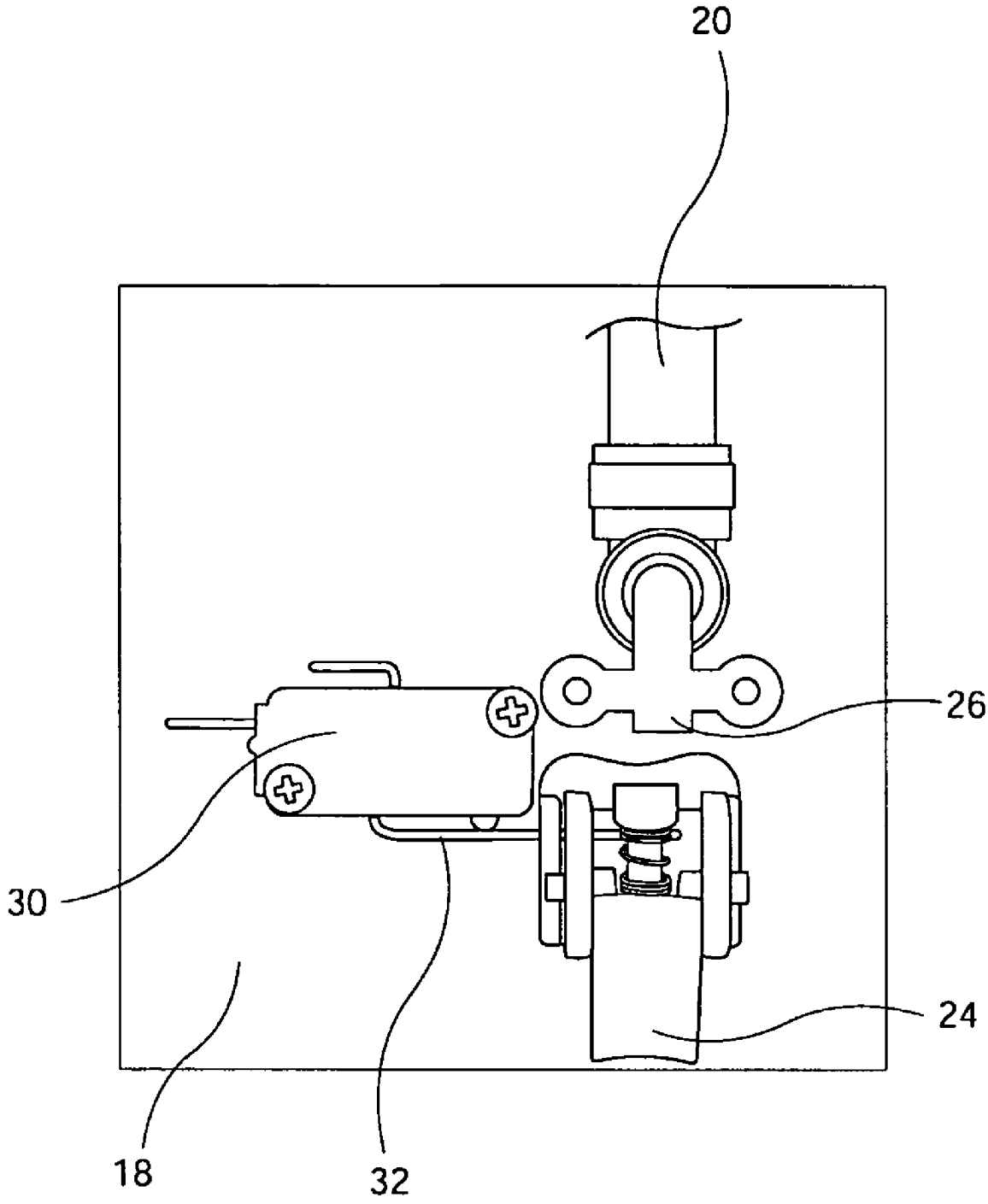
FIG. 2 is a schematic view showing the configuration of a major portion of a conventional dispenser for a refrigerator.
Figure 3:
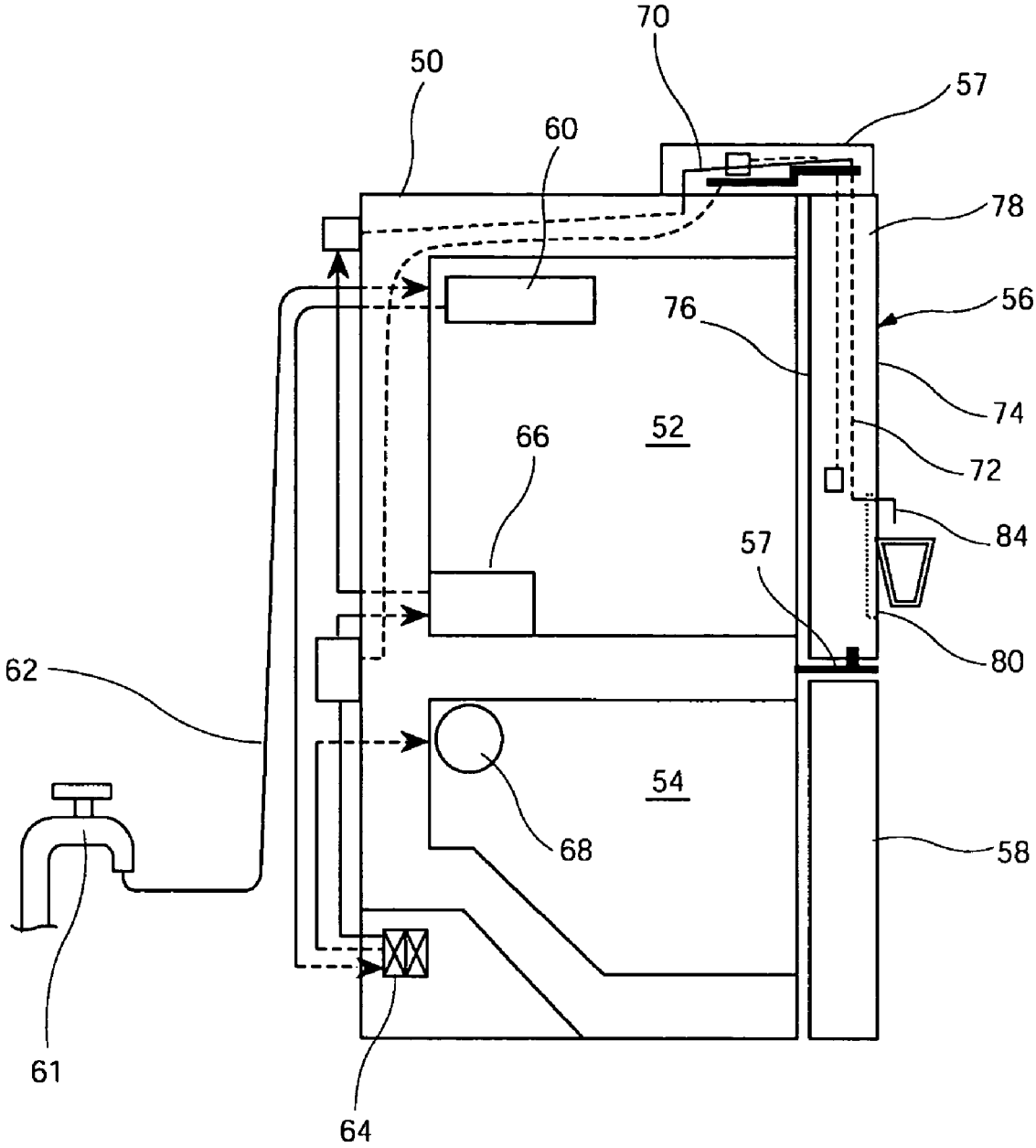
FIG. 3 is a sectional view showing the inner configuration of a refrigerator employing a preferred embodiment of a dispenser for a refrigerator according to the present invention.
Figure 4:
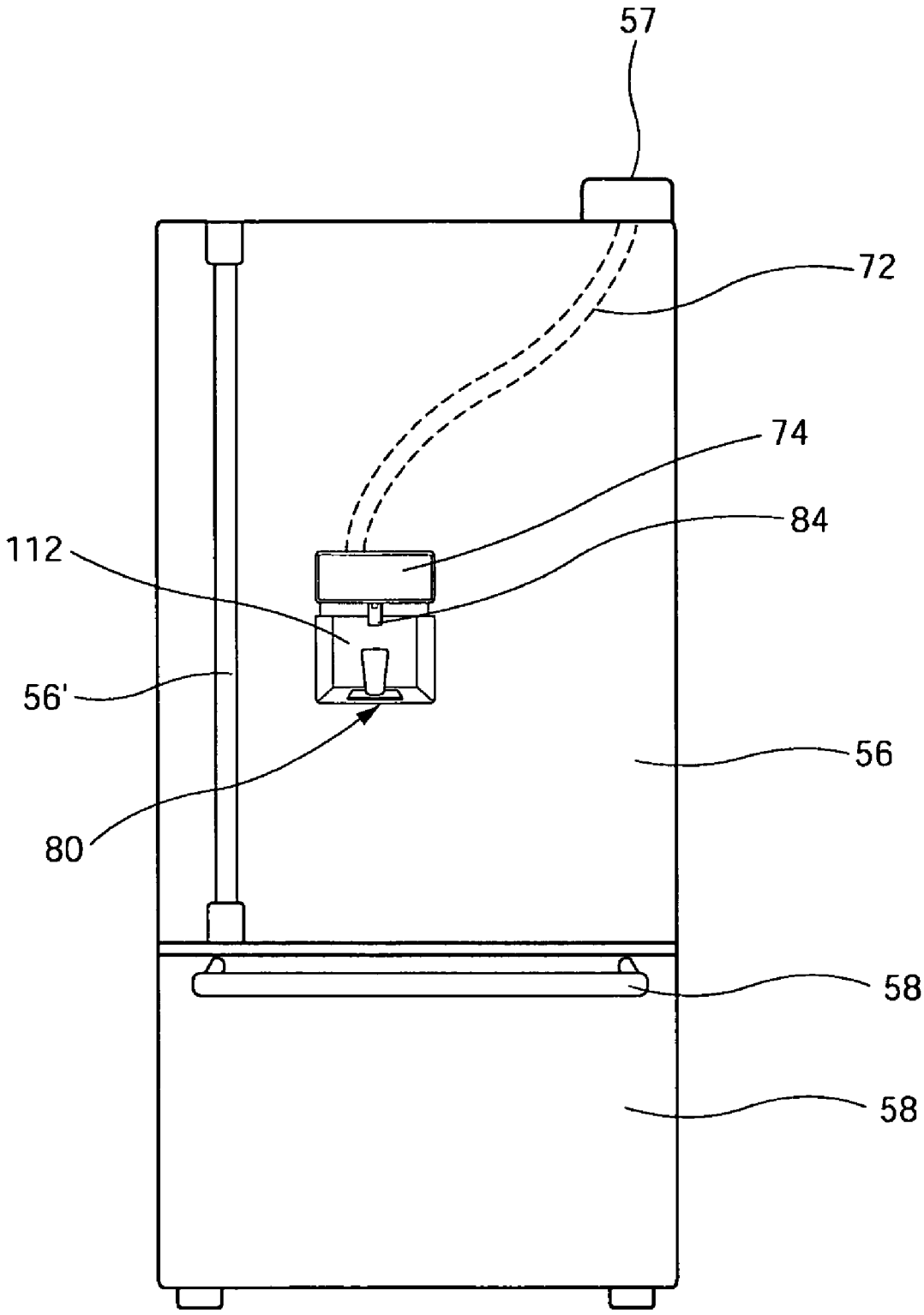
FIG. 4 is a front view showing the configuration of a front face of the refrigerator employing the embodiment of the present invention.
Figure 5:
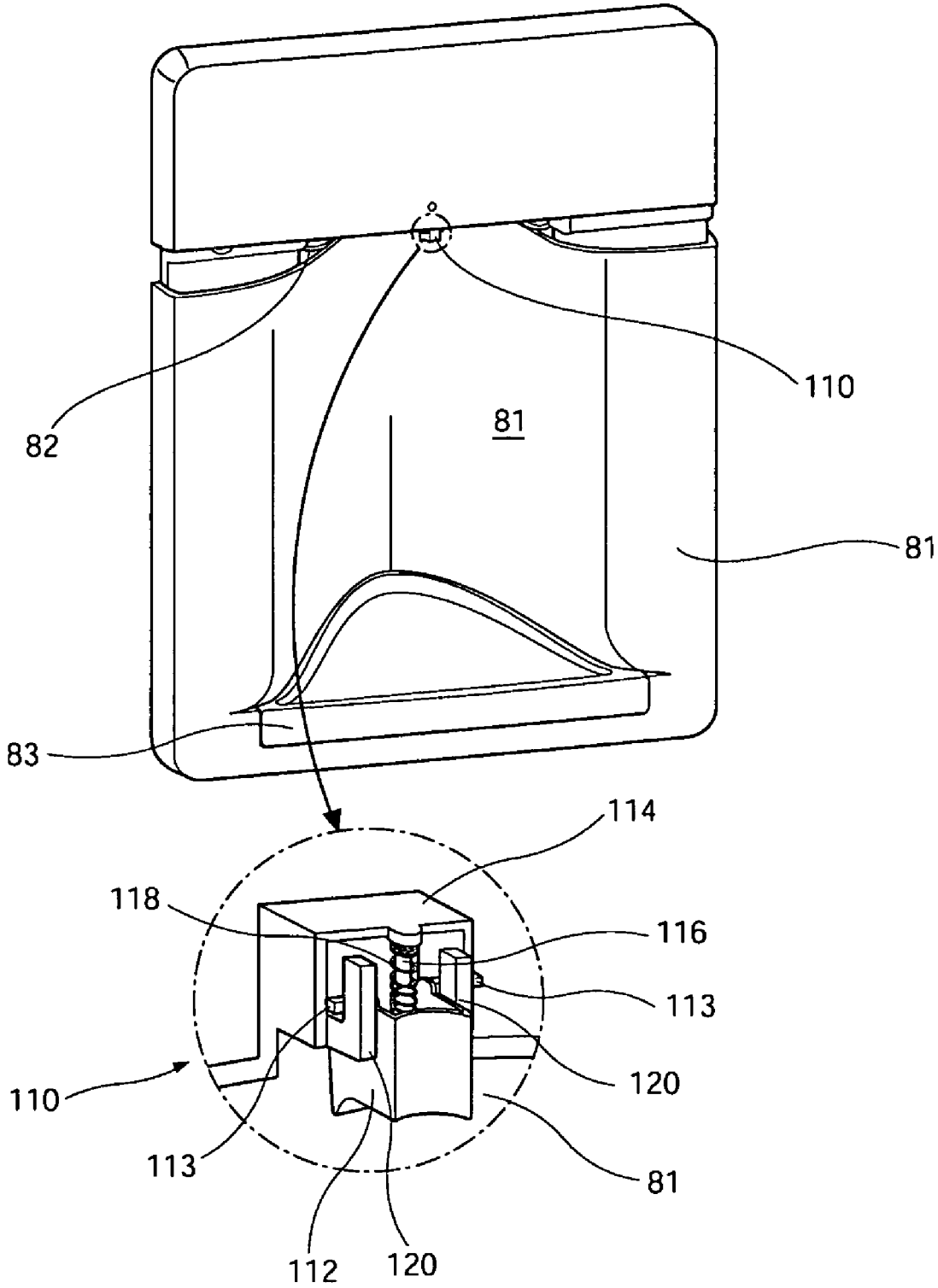
FIG. 5 is a perspective view showing the configuration of a major portion of the embodiment of the present invention.
Figure 6:
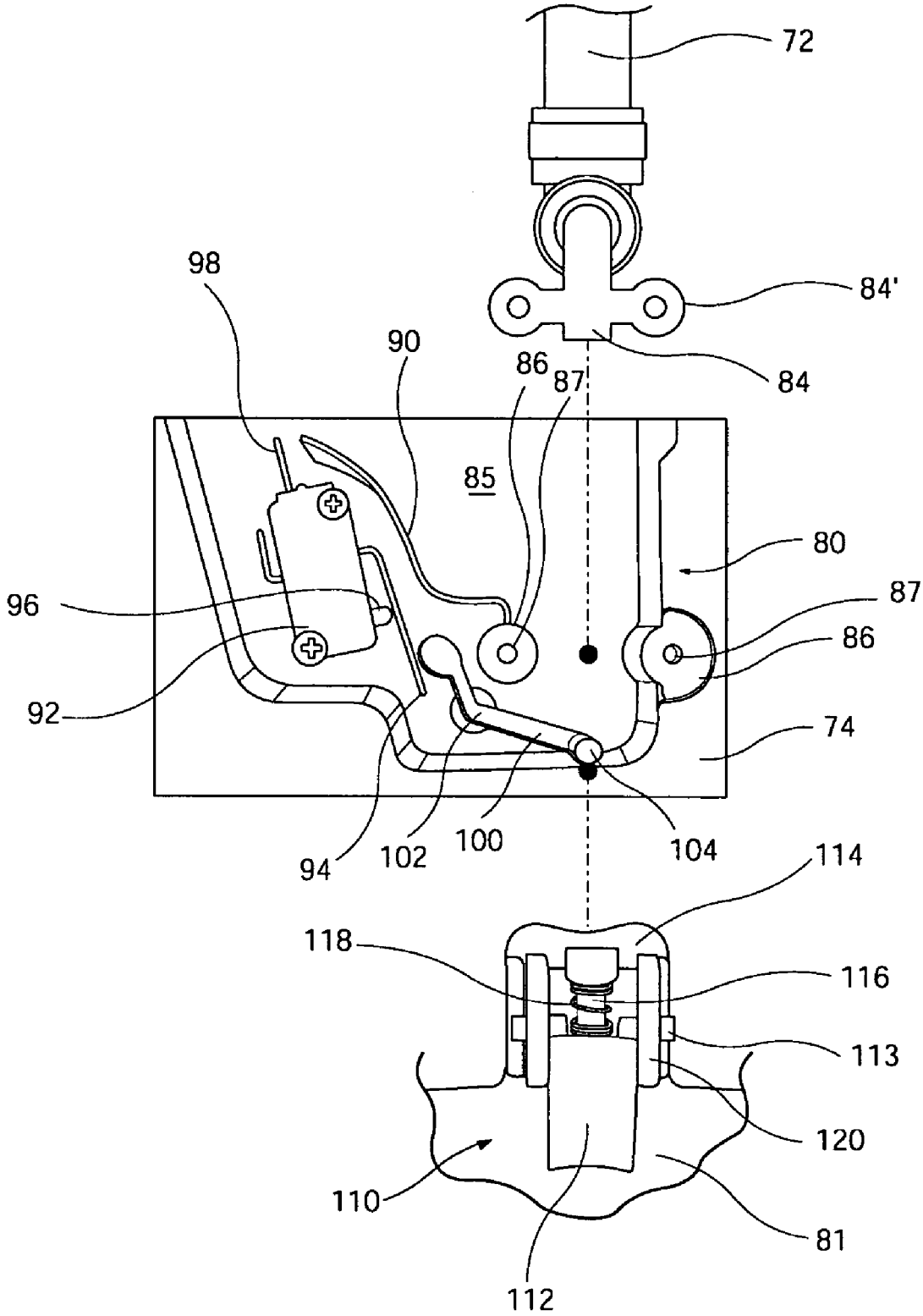
FIG. 6 is a perspective view schematically showing the configuration of a major portion of the embodiment of the present invention.

FIG. 3 is a sectional view showing the inner configuration of a refrigerator employing a dispenser for a refrigerator according to an embodiment of the present invention, and FIG. 4 is a front view showing the configuration of a front face of the refrigerator employing the dispenser according to the embodiment of the present invention.

As shown in the figures, the interior of a main body 50 of the refrigerator is partitioned into a refrigerating chamber 52 and a freezing chamber 54 in an up and down direction. The refrigerating chamber 52 is disposed at a relatively upper portion of the main body 50, and the freezing chamber 54 is disposed at a relatively lower portion thereof.

The main body 50 is provided with a refrigerating chamber door 56 and a freezing chamber door 58 to selectively open and close the refrigerating and freezing chambers 52 and 54, respectively. In the embodiment, the door 56 is pivotably supported by the main body 50 through hinges 57 provided at right upper and lower ends in FIG. 3.

The refrigerating and freezing chamber doors 56 and 58 are provided with door handles 56' and 58', respectively. The door handles 56' and 58' are portions that a user grasps with his/her hand to exert force thereon, thereby opening and closing the doors 56 and 58.

A filter 60 is installed within the refrigerating chamber 52. The filter 60 serves to purify water. The filter 60 is supplied with the water through a supply tube 62 connected to an external water supply source 61.

A valve 64 is provided at a side of the main body 50. The valve 64 serves to distribute the water, which has passed through the filter 60, among a water reservoir 66, an ice maker 68 and the like. The water reservoir 66 and the ice maker 68 are provided in the refrigerating and freezing chambers 52 and 54, respectively. The water reservoir 66 stores the water purified by the filter 60, and the ice maker 68 makes ice from the water purified by the filter 60.

The main body 50 is provided with main body-side tubing 70 for delivering the water stored in the water reservoir 66 to the refrigerating chamber door 56. A leading end of the main body-side tubing 70 is exposed beyond an upper end of the main body 50 and extends through the upper hinge 57 to communicate with door-side tubing 72 installed within the door 56.

The door-side tubing 72 is installed through an insulation layer 78 formed between an outer case 74 for defining an external appearance of at least a front surface of the refrigerating chamber door 56 and an inner case 76 for defining an external appearance of a back surface of the refrigerating chamber door.

Meanwhile, a dispenser 80 is provided in the front surface of the door 56. The dispenser 80 is a portion for dispensing the water delivered from the water reservoir 66 to the outside of the door 56. An external appearance of the dispenser 80 is defined by a housing 81. The housing 81 is mounted on the outer case 74 for constituting the front surface of the door 56.

The housing 81 has a recessed portion 81' formed in such a manner that a front surface of the housing is depressed rearward. A corresponding recessed portion should also be formed in a front surface of the outer case 74 at a position corresponding to the recessed portion 81'. A penetration portion 82 is formed at an upper end of the recessed portion 81'. The penetration portion 82 is a portion through which water that will be discharged through a dispensing port 84 or the like to be described later is delivered to the recessed portion 81'. A drain water collector 83 is provided at a lower end of the recessed portion 81'.

The dispensing port 84 is provided at a leading end of the door-side tubing 72. The dispensing port 84 allows the water delivered from the water reservoir 66 to be discharged through the penetration portion 82 to a cup placed in the recessed portion 81'. Both side ends of the dispensing port 84 are provided with fixing portions 84'.

A seating recess 85 is formed to be depressed on the outer case 74 at a position corresponding to the penetration portion 82 of the housing 81 and a back surface of a portion of the housing above the penetration portion. The seating recess 85 may be formed on the outer case 74 itself, or on a surface of the insulation layer 78 by partially cutting away a corresponding portion of the outer case 74. The seating recess 85 cannot be easily viewed from the outside since it is concealed by the housing 81.

Fastening bosses 86 for fixing the dispensing port 84 are formed at respective positions within and adjacent to the seating recess 85. One of the fastening bosses 86 is formed to protrude by a predetermined height within the seating recess 85, and the other of the fastening bosses is formed to be slightly depressed at a position adjacent to the seating recess 85. Fastening holes are formed in the fastening bosses 86, respectively.

A partition 90 is formed over a predetermined range within the seating recess 85. The partition 90 divides the interior of the seating recess into a portion where the door-side tubing 72 and the dispensing port 84 are placed and a portion where an actuating switch 92 is installed. More specifically, the partition 92 serves to prevent the water discharged from the dispensing port 84 or the like from being transferred to the actuating switch 92.

The actuating switch 92 is operated by a water-dispensing button 112 to be described later and serves to allow water to be discharged through the dispensing port 84. For example, the actuating switch 92 operates a valve disposed between the dispensing port 84 and the water reservoir 66 so that water can be discharged from the water reservoir 66 through the dispensing port 84.

The actuating switch 92 is formed with an elongated, protruding resilient rib 94 and a driving protrusion 96 that comes into contact with the resilient rib 94. The driving protrusion 96 is pressed by the resilient rib 94 and then senses an operating signal. Reference numeral 98 designates a connection terminal. The operating switch 92 is installed in a region of the seating recess 85 isolated from the dispensing port 84 by means of the partition 90.

A driving lever 100 is installed in the seating recess 85. The driving lever 100 is constructed to pivot on a hinge portion 102 so that both ends of the driving lever can move in the same manner as a seesaw. Further, the driving lever 100 is constructed such that the both ends thereof define a predetermined angle around the hinge portion 102 rather than a straight line. The angle defined by the both ends of the driving lever 100 can be variously determined according to the positions of the actuating switch 92 and the water-dispensing button 112 to be described later. With such a constitution, one of the ends of the driving lever 100 on the side of the actuating switch 92 is placed at a position relatively higher than the other end of the driving lever on the side of the water-dispensing button 112. This is to prevent water from moving toward the actuating switch 92 due to the weight of the water.

The hinge portion 102 can be constructed, for example, by forming a hinge pin (not shown) on the driving lever 100 and a hinge hole (not shown) into which the hinge pin is inserted at a corresponding portion of the seating recess 85, or vice versa.

The other end of the driving lever 100, i.e. the end thereof on the side of the water-dispensing button 112 to be described later, is formed with a connection protrusion 104. The connection protrusion 104 is formed to extend toward the back surface of the housing 81 in a state where the driving lever 100 is installed within the seating recess 85. The end of the driving lever 100 opposite to the other end thereof with the connection protrusion 104 is in contact with the resilient rib 94.

The other end of the driving lever 100 with the connection protrusion 104 and the opposite end thereof extend in a direction generally perpendicular to the direction of gravity. This is to prevent water, which has been discharged from the dispensing port 84 and is falling due to gravity, from being transferred to the actuating switch 92 through the resilient rib 94 or the like.

Next, a water-dispensing button unit 110 is installed at the upper end of the recessed portion 81' of the housing 81, i.e. at a position adjacent to the penetration portion 82. The water-dispensing button unit 110 operates the driving lever 100 to turn on the actuating switch 92.

The water-dispensing button unit 110 is provided with the water-dispensing button 112. The water-dispensing button 112 protrudes downward by a predetermined length from an upper portion of the recessed portion 81' and is installed to move in an up and down direction. The water-dispensing button 112 is pushed upward by a cup grasped by a user to operate the driving lever 100.

Catching ribs 113 are formed to protrude in opposite directions at both side ends of the water-dispensing button 112. A back surface of the water-dispensing button 112 is provided with a structure that can be firmly connected to the connection protrusion 104 of the driving lever 100. For example, the back surface of the water-dispensing button is provided with an insertion hole into which the connection protrusion 104 can be inserted.

The water-dispensing button 112 is placed on a support frame 114 formed at the upper end of the recessed portion 81'. The support frame 114 is constructed to partially surround the water-dispensing button 112. The support frame 114 is formed with a support protrusion 116 protruding in the vertical moving direction of the water-dispensing button 112. One end of a return spring 118 is supported by the support protrusion 116. The other end of the return spring 118 is supported by an upper end of the water-dispensing button 112 so that the water-dispensing button 112 can be moved to the original position when force pressing the water-dispensing button 112 is eliminated.

The support frame 114 has guide ribs 120 at both ends thereof. The catching ribs 113 are movably placed between the guide ribs 120 and an upper end of the support frame 114 so that the up and down movement of the water-dispensing button 112 can be guided. Of course, the catching ribs 113 are caught by the guide ribs 120 such that the guide ribs serve to prevent the catching ribs from being further moved downward.

Next, the operation of the dispenser for the refrigerator according to the present invention constructed as above will be described in detail.

Water supplied from the external water supply source 61 is purified through the filter 60 and then delivered to the ice maker 68 and the water reservoir 66. The water stored in the water reservoir 66 is discharged from the dispensing port 84 through the main body-side tubing 70 and the door-side tubing 72 as the dispenser 80 is operated.

The discharge from the dispensing port 84 due to the operation of the dispenser 80 will be described below. When a user pushes the water-dispensing button 112 with a cup, the water-dispensing button 112 moves upward while overcoming elastic force of the return spring 118 within the support frame 114.

When the water-dispensing button 112 is moved, the driving lever 100 connected to the water-dispensing button 112 through the connection protrusion 104 is pivoted. The driving lever 100 is pivoted counterclockwise on the hinge portion 102 due to the upward movement of the water-dispensing button 112. The end of the driving lever 100 presses the driving protrusion 96 of the actuating switch 92 by means of the pivoting of the driving lever 100. When the driving protrusion 96 is pressed, the actuating switch 92 senses that the water-dispensing button 112 has been operated.

A sensing signal generated from the actuating switch 92 drives a valve for allowing water to be discharged from the dispensing port 84. Therefore, the water stored in the water reservoir 66 is discharged from the dispensing port 84 and then dispensed into the cup of the user.

Meanwhile, when a desired amount of water is filled into the cup of the user, the user separates the cup from the water-dispensing button 112. Thus, the water-dispensing button 112 is moved to the original position due to the restoring force of the return spring 118. That is, the catching ribs 113 are moved downward along between the upper end of the support frame 114 and the guide ribs 120 and then caught by the guide ribs 120. In such a state, the water-dispensing button 112 cannot be further moved downward.

As the water-dispensing button 112 is moved downward, the driving lever 100 connected to the water-dispensing button 112 through the connection protrusion 104 is pivoted clockwise on the hinge portion 102. With the clockwise pivoting of the driving lever 100, the driving lever 100 does not press the resilient rib 94 any longer. Therefore, the resilient rib 94 is restored to an original state and the driving protrusion 96 is also returned to the original state, thereby turning off the actuating switch 92. In such a state, water is not discharged from the dispensing port 84 any longer.

Meanwhile, water is hardly transferred to the actuating switch 92 while the water is discharged from the dispensing port 84 in the dispenser 80 as described above. This is because the partition 90 is disposed between the dispensing port 84 and the actuating switch 92.

Further, since the actuating switch 92 is connected to the water-dispensing button 112 through the driving lever 100, the actuating switch 92 is spaced relatively further apart from the dispensing port 84 and the water-dispensing button 112. Thus, a portion of the water discharged from the dispensing port 84 is not transferred to the actuating switch 92.

The scope of the present invention is not limited to the embodiment described above and those skilled in the art can make various modifications and changes thereto within the scope of the invention.

For example, parts provided within the seating recess 85 may be provided on the back surface of the housing 81 and only the water-dispensing button 112 may be exposed to the front of the recessed portion 81' of the housing 81.

According to the dispenser for the refrigerator of the present invention specifically described above, it is expected to obtain the following advantages.

Since the actuating switch is operated through the driving lever by the water-dispensing button in the present invention, the distance between the dispensing port from which water is discharged and the actuating switch is relatively increased. Thus, it is possible to prevent water from being transferred to the actuating switch while water discharged from the dispensing port falls due to gravity.

Since the partition is disposed between the actuating switch and the dispensing port, a portion of water is not transferred toward the actuating switch even though the portion of water is splashed aside. Thus, malfunction of the actuating switch due to a short circuit can be avoided.

What is claimed is:

1. A dispenser for a refrigerator, comprising:

a housing mounted on a front surface of a door to define an external appearance, the housing having a recessed portion formed to be depressed rearward;

a dispensing port for discharging water delivered from a main body of the refrigerator to the recessed portion of the housing;

a water-dispensing button unit having a water-dispensing button pressed by means of force exerted by a user to receive a signal necessary for the discharge of the water from the dispensing port;

an electrical actuating switch operated by the water-dispensing button unit to generate an electrical signal for opening and closing the dispensing port; and a driving lever for connecting the actuating switch and the water-dispensing button to drive the actuating switch by means of the operation of the water-dispensing button.

2. The dispenser as claimed in claim 1, wherein a penetration portion is formed at an upper end of the recessed portion of the housing so that the water discharged from the dispensing port can be delivered to the recessed portion.

3. The dispenser as claimed in claim 1, wherein the water-dispensing button unit comprises:

a support frame for guiding the movement of the water-dispensing button; and a resilient member disposed between the support frame and the water-dispensing button to provide force to the water-dispensing button in one direction.

4. The dispenser as claimed in claim 1, wherein the water-dispensing button unit is provided, at mutually corresponding positions of the water-dispensing button and the support flame, with catching ribs and guide ribs for guiding the movement of the water-dispensing button and regulating the moved position of the water-dispensing button, respectively.

5. The dispenser as claimed in claim 1, wherein an ON/OFF driving protrusion of the actuating switch is operated by an elastically deformable resilient rib provided at a side of the actuating switch, and the resilient rib is operated by one end of the driving lever.

6. The dispenser as claimed in claim 1, wherein the driving lever pivots on a hinge portion such that both ends thereof move in the same manner as a seesaw, and one end of the driving lever is connected to and interlocked with the water-dispensing button through a connection protrusion and the other end thereof is in contact and interlocked with the actuating switch.

7. The dispenser as claimed in claim 6, wherein the other end of the driving lever that is in contact with the actuating switch is placed at a position relatively higher than the end of the driving lever that is connected to the water-dispensing button with respect to the hinge portion.

8. The dispenser as claimed in claim 6, wherein the both ends of the driving lever define a predetermined angle around the hinge portion, and the other end of the driving lever that is in contact with the actuating switch is placed at a position relatively higher than the end of the driving lever that is connected to the water-dispensing button.

9. The dispenser as claimed in claim 1, further comprising a partition between the actuating switch and the dispensing port.

10. The dispenser as claimed in claim 1, wherein the dispensing port, the actuating switch and the driving lever are placed in a seating recess formed to be depressed on the front surface of the door; and the water-dispensing button unit is provided at an upper end of the recessed portion of the housing.

11. A dispenser for a refrigerator, comprising:

a housing mounted on a front surface of a door to define an external appearance, the housing having a recessed portion formed to be depressed rearward;

a dispensing port for discharging water delivered from a main body of the refrigerator through a penetration portion formed at an upper end of the recessed portion of the housing;

a water-dispensing button unit having a water-dispensing button pressed by means of force exerted by a user to receive a signal necessary for the discharge of the water from the dispensing port;

an actuating switch operated by the water-dispensing button unit and turned on and off in such a manner that a resilient rib provided at a side of the actuating switch presses a driving protrusion thereof by means of elastic deformation of the resilient rib so as to generate a signal for opening and closing the dispensing port;

a driving lever for connecting the actuating switch and the water-dispensing button to drive the actuating switch by means of the operation of the water-dispensing button; and a partition disposed between the actuating switch and the dispensing port to prevent the water discharged from the dispensing port from being transferred to the actuating switch.

12. The dispenser as claimed in claim 11, wherein the water-dispensing button unit comprises:

a support frame for guiding the movement of the water-dispensing button; and a resilient member disposed between the support frame and the water-dispensing button to provide force to the water-dispensing button in one direction.

13. The dispenser as claimed in claim 11, wherein the driving lever pivots on a hinge portion such that both ends thereof move in the same manner as a seesaw, and one end of the driving lever is connected to and interlocked with the water-dispensing button through a connection protrusion and the other end thereof is in contact and interlocked with the actuating switch.

14. The dispenser as claimed in claim 13, wherein the other end of the driving lever that is in contact with the actuating switch is placed at a position relatively higher than the end of the driving lever that is connected to the water-dispensing button with respect to the hinge portion.

15. The dispenser as claimed in claim 13, wherein the both ends of the driving lever define a predetermined angle around the hinge portion, and the other end of the driving lever that is in contact with the actuating switch is placed at a position relatively higher than the end of the driving lever that is connected to the water-dispensing button.

* * * * *